United States Patent [19]

Ohgami et al.

[11] 4,375,796

[45] Mar. 8, 1983

[54] AIR-FUEL RATIO CONTROL SYSTEM

[75] Inventors: Masaaki Ohgami; Fujio Matsui, both of Musashino, Japan

[73] Assignees: Fuji Jukogyo Kabushiki Kaisha, Tokyo; Nissan Motor Co., Ltd., Yokohama, both of Japan

[21] Appl. No.: 240,649

[22] Filed: Mar. 5, 1981

[30] Foreign Application Priority Data

Mar. 7, 1980 [JP] Japan ..... 55-29337

[51] Int. Cl.[3] ..... F02D 35/00

[52] U.S. Cl. ..... 123/440; 123/489

[58] Field of Search ..... 123/440, 489

[56] References Cited

U.S. PATENT DOCUMENTS 4,108,121 8/1978 Minami et al. ..... 123/440

4,214,558 7/1980 Nishioka et al. ..... 123/440

*Primary Examiner*—Tony M. Argenbright

*Attorney, Agent, or Firm*—Martin A. Farber

[57] ABSTRACT

An air-fuel ratio control system for an internal combustion engine which comprises an intake passage, an exhaust passage, an air-fuel mixture supply device, an on-off type electromagnetic valve for correcting the air-fuel ratio of the air-fuel mixture supplied by the air-fuel mixture supply device, a dither signal generating circuit for producing a periodical dither signal, a shift control circuit for shifting the level of the center of the dither signal, a driving circuit for producing a driving output for the on-off type electromagnetic valve, and an $O_2$ sensor for detecting the concentration of oxygen in exhaust gases passing through the exhaust passage. A first circuit is provided for detecting a middle value between the maximum value and minimum value of the output voltage of the $O_2$ sensor in each cycle, and a second circuit is provided for detecting a middle value with respect to the output waveform of the $O_2$ sensor such that the areas thereof above and below the latter middle value are equal. A shift signal generating circuit is provided for comparing the outputs of the first and second circuits for generating the difference as a shift signal. The shift control circuit is so arranged to control the air-fuel ratio of the mixture in such a direction that the difference is decreased.

3 Claims, 9 Drawing Figures

PRIOR ART

AIR-FUEL RATIO CONTROL SYSTEM

BACKGROUND OF THE INVENTION

The present invention relates to a system for controlling the air-fuel ratio for an internal combustion engine emission control system which comprises a three-way catalyst, and more particularly to a system for controlling the air-fuel ratio to a value approximating the stoichiometric air-fuel ratio so as to effectively operate the three-way catalyst.

Such a system is a feedback control system, in which an $O_2$ sensor is provided to detect the oxygen content of the exhaust gases to generate an electrical signal as an indication of the air-fuel ratio of the air-fuel mixture supplied by a carburetor. The control system comprises a comparator for comparing the output signal of the oxygen sensor with a predetermined value, an integrating circuit connected to the comparator, a driving circuit for producing square wave pulses from the output signal of the integrating circuit, and an on-off type electromagnetic valve for correcting the air-fuel ratio of the mixture. The control system operates to determine whether the feedback signal from the $O_2$ sensor is higher or lower than a predetermined reference value corresponding to the stoichiometric air-fuel ratio for producing an error signal for actuating the on-off type electromagnetic valve to thereby control the air-fuel ratio of the mixture.

In the conventional system, as shown in FIGS. 1*a* and 1*b*, the output waveform $P_1$ of the $O_2$ sensor varies from a maximum output voltage thereof to a minimum one, because the $O_2$ concentration in the exhaust gases exceeds values corresponding to the maximum and minimum outputs due to the control delay of the control system. As shown in FIG. 1*a*, the output voltage of the $O_2$ sensor varies steeply at a reference voltage $V_R$ which corresponds to the output voltage caused by exhaust gases when a mixture of the stoichiometric air-fuel ratio (St) is supplied to the engine and burned. Therefore, it may be regarded that a middle value M between the maximum and minimum values in each cycle of the output waveform of the $O_2$ sensor is constant and substantially equal to the voltage $V_R$ corresponding to the stoichiometric air-fuel ratio. Thus, in the conventional system, the middle value M is set as the reference value of the comparator for comparing the air-fuel ratio of the mixture supplied to the engine.

On the other hand, copending Patent application Ser. No. 174,385, which was assigned to the same assignee as this patent application, discloses a system intended for improvement of the control delay in such a conventional system, in which the on-off electromagnetic valve is operated by a dither signal having a high frequency and a small amplitude. However, it is not proper to use the middle value of each cycle in the output waveform $P_2$ of the $O_2$ sensor dependent on the dither signal D as a reference value, because the middle value of the output waveform of the $O_2$ sensor does not always coincide with the reference voltage $V_R$ corresponding to the stoichiometric value, as shown in FIG. 1*b*. Therefore, the middle value cannot be used as a reference value.

SUMMARY OF THE INVENTION

The object of the present invention is to provide an air-fuel ratio control system which controls the air-fuel ratio to the stoichiometric air-fuel ratio without using any reference value, whereby, the air-fuel ratio can be exactly controlled to the stoichiometric air-fuel ratio.

According to the present invention there is provided an air-fuel ratio control system for an internal combustion engine having an intake passage, and exhaust passage, an air-fuel mixture supply means, on-off type electromagnetic valve for correcting the air-fuel ratio of the air-fuel mixture supplied by said air-fuel mixture supply means, dither signal generating circuit means for producing a periodical dither signal, a shift control circuit means for shifting the level of the center of the dither signal, driving circuit means for producing a driving output for said on-off type electromagnetic valve, and an $O_2$ sensor for detecting the concentration of the oxygen in the exhaust gases passing through said exhaust passage, with the improvement comprising first circuit means for detecting a middle value between the maximum value and the minimum value of the output voltage of said $O_2$ sensor in each cycle, second circuit means for detecting a middle value with respect to the output waveform of the $O_2$ sensor such that the areas thereof above and below the latter middle value are equal, and shift signal generating circuit means for comparing the outputs of said first and second circuit means for generating the difference as a shift signal, said shift control circuit means being so arranged to control the air-fuel ratio of the mixture in such a direction that said difference is decreased.

Other objects and features of the present invention will be apparent from the following description with reference to the accompanying drawings.

DETAILED DESCRIPTION OF THE PREFERRED EMBODIMENTS

Figure 4:
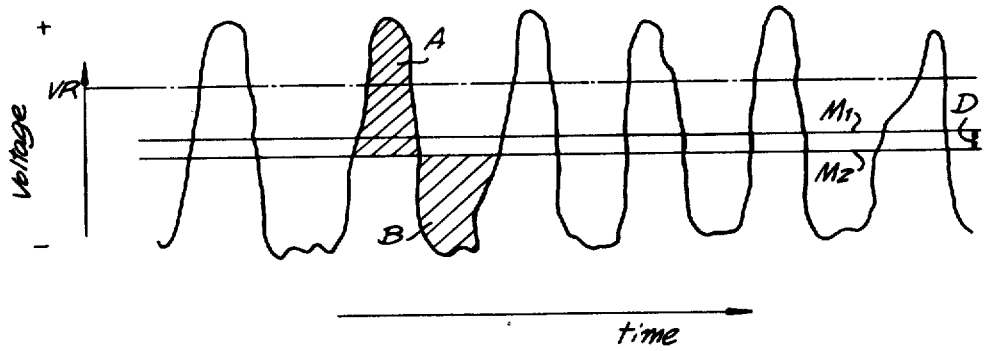
FIG. 4 is a graph showing the output waveforms of the $O_2$ sensor.

Now describing the principle of the present invention referring to FIG. 4, the figure shows the output waveform of the $O_2$ sensor when the level of the output voltage is lower than the reference voltage $V_R$, which means that a lean air-fuel mixture is supplied to the engine. Because of the lower output voltage, the bottom of the waveform is limited to a low voltage due to the characteristics of the $O_2$ sensor. Therefore, an upper half and a lower half of the waveform of each cycle are different in shape. The reference $M_1$ represents a middle value of the height of the wave and $M_2$ represents a middle value which divides the wave into equivalent area portions A and B. If the middle value $M_1$ between the maximum voltage and the minimum voltage of each cycle in the output waveform coincides with the reference voltage $V_R$, then the area of the portion of the wave higher than the height middle value line $M_1$ of each cycle is equal to the area of the lower portion thereof.

Thus, in accordance with the present invention, the air-fuel ratio of the mixture is controlled so that the height middle value $M_1$ can be equal to the middle value $M_2$.

Figure 1B:
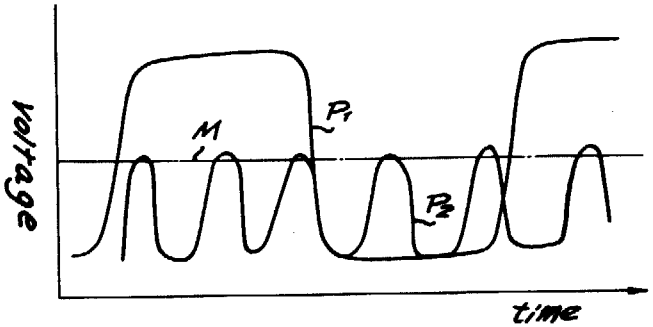
FIGS. 1*a* and 1*b* are graphs showing the output signal of the $O_2$ sensor of a conventional system.
Figure 1A:
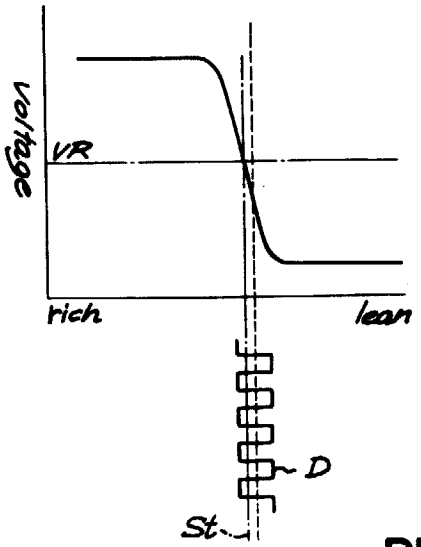
Figure 2:
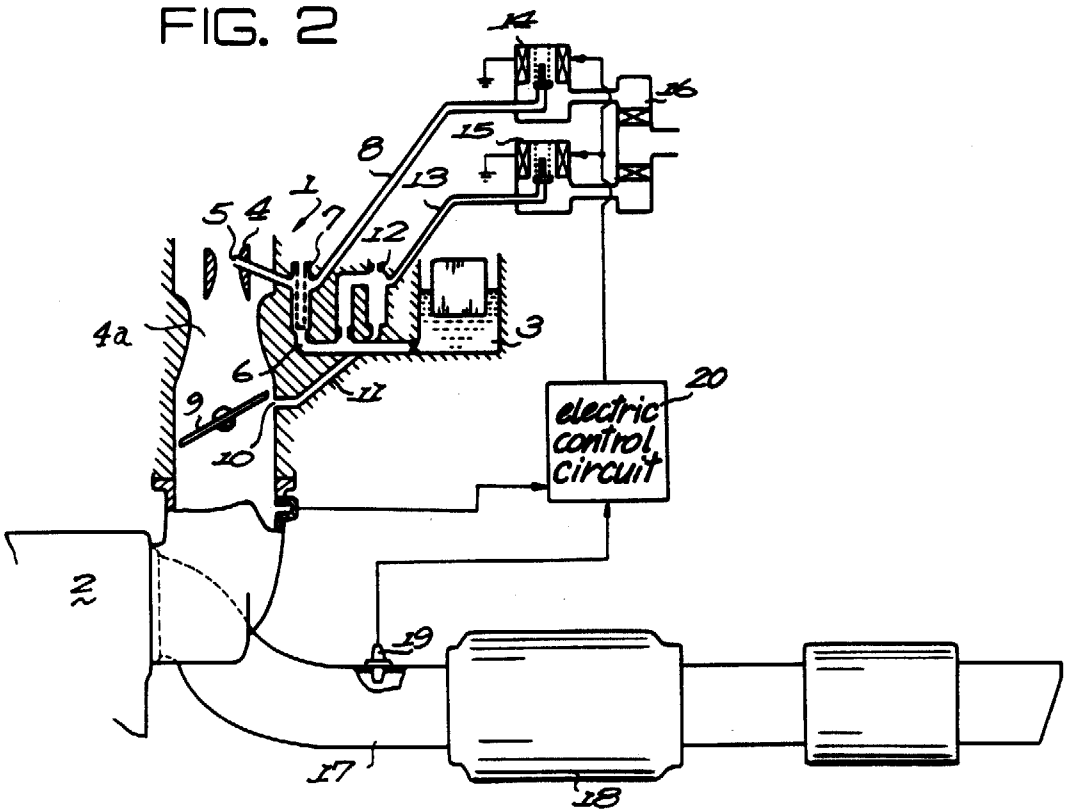
FIG. 2 is a schematic view of a system according to the present invention.

Referring to FIG. 2, a carburetor 1 communicates with an internal combustion engine 2. The carburetor 1 comprises a float chamber 3, a venturi 4 formed in an intake passage 4a, a nozzle 5 communicating with the float chamber 3 through a main fuel passage 6, and a slow port 10 provided near a throttle valve 9 in the intake passage communicating with the float chamber 3 through a slow fuel passage 11. Air correcting passages 8 and 13 are disposed in parallel to a main air bleed 7 and a slow air bleed 12, respectively. On-off type electromagnetic valves 14 and 15 are provided for the air correcting passages 8 and 13, respectively. Inlet ports of each on-off electromagnetic valve 14, 15 respectively communicates with the atmosphere through an air filter or air cleaner 16. An $O_2$ sensor 19 is disposed in an exhaust pipe 17 which communicates with the internal combustion engine 2. The $O_2$ sensor 19 detects the oxygen content of the exhaust gases. A three-way catalytic converter 18 is provided in the exhaust pipe 17 downstream of the $O_2$ sensor 19. The output signal of the $O_2$ sensor 19 is applied to an electronic control circuit 20 of an electronic control system. The electronic control circuit 20 operates to correct the air-fuel ratio of the air-fuel mixture provided by the carburetor 1.

Figure 3:
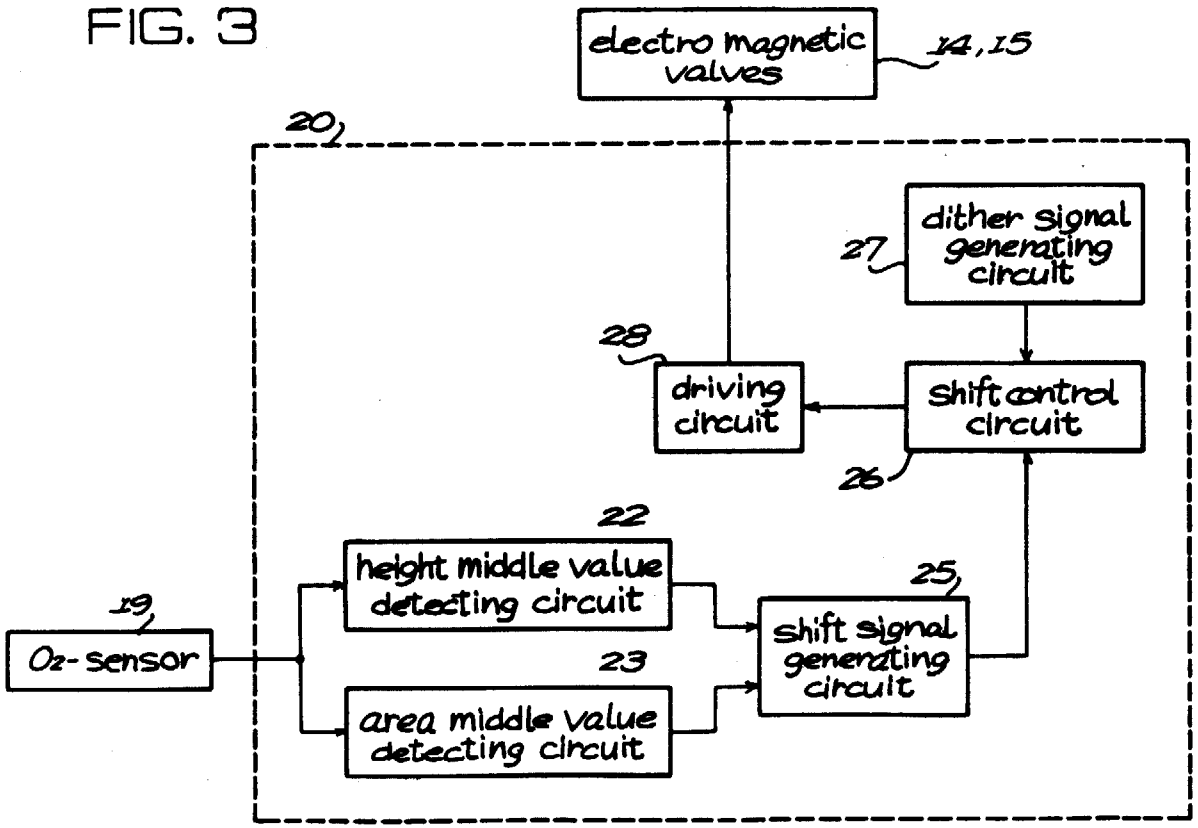
FIG. 3 is a block diagram of an electronic control circuit of the system.

FIG. 3 shows the block diagram of the electronic control circuit 20.

The output of the $O_2$ sensor 19 is connected to a wave height middle value detecting circuit 22 and to an area middle value detecting circuit 23. The height middle value detecting circuit 22 is adapted to obtain a middle value $M_1$ between the maximum and minimum output voltages of the $O_2$ sensor 19. The area middle value detecting circuit 23 is adapted to obtain a middle value between areas of upper and lower portions of the output waveform of the $O_2$ sensor with respect to a predetermined reference level, for example the height middle value $M_1$. Outputs of both circuits 22 and 23 are connected to a shift signal generating circuit (comparator) 25 which is adapted to generate a shift signal dependent on the difference between the outputs of both circuits 22, 23 for shifting the center of a dither signal wave. The output of the shift signal generating circuit 25 is connected to the shift control circuit 26 which acts to shift the center of the dither signal fed from a dither signal generating circuit 27 in dependency on the output of the shift signal generating circuit 25. The output of the shift control circuit 26 is fed to the on-off type electromagnetic valves 14 and 15 through a driving circuit 28 for actuating the valves 14 and 15 so as to control the air-fuel ratio of the mixture.

In accordance with the present invention, the shift control circuit 26 operates to shift the center of the dither signal in such a direction that the difference (D) between the outputs of circuits 22 and 23 is decreased. Thus, the air-fuel ratio of the mixture can be controlled to the stoichiometic air-fuel ratio.

Figure 5:
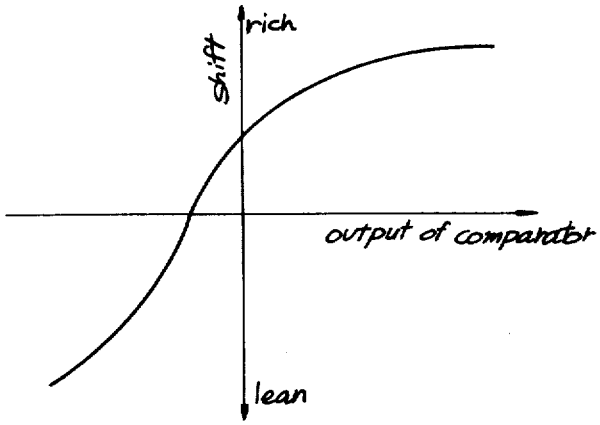
FIG. 5 shows an example of the relation between the output of a comparator and the shifting of the dither signal.

In a case where there is a difference between the controlled air-fuel ratio and the stoichiometric air-fuel ratio due to an error of the characteristic of the $O_2$ sensor, the shift signal is modulated in accordance with a suitable function. FIG. 5 shows an example of the modulation of the shift signal.

Figure 6:
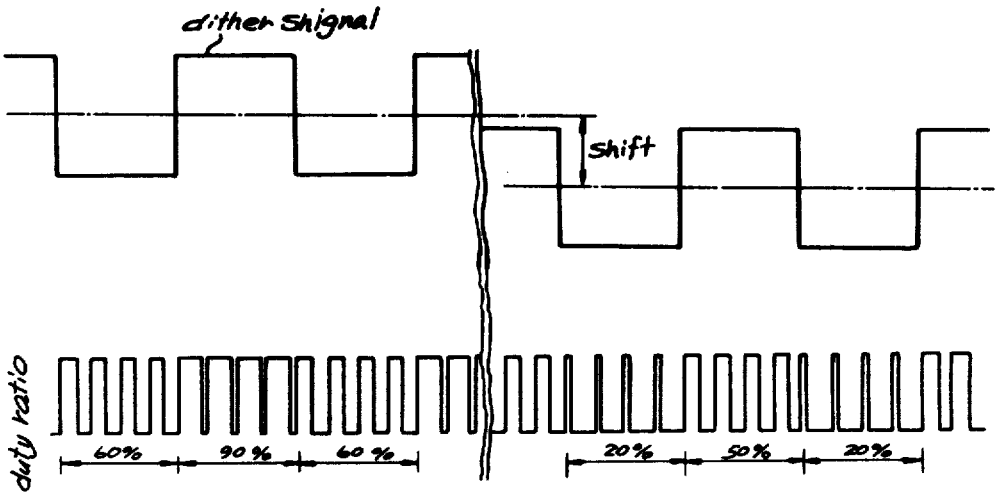
FIG. 6 is a graph showing the relation between the dither signal and the operation of a valve.

FIG. 6 shows the relation between the shifting of the dither signal and the duty ratio of the electromagnetic valve. When the level of the dither signal is low, the duty ratio is small as 20%. The left half of FIG. 6 shows the condition when the dither signal deviates to the higher side and the right half shows when the dither signal is in a lower level. From the figure, it will be seen that the air-fuel ratio of the mixture is controlled by shifting the dither signal.

Figure 7:
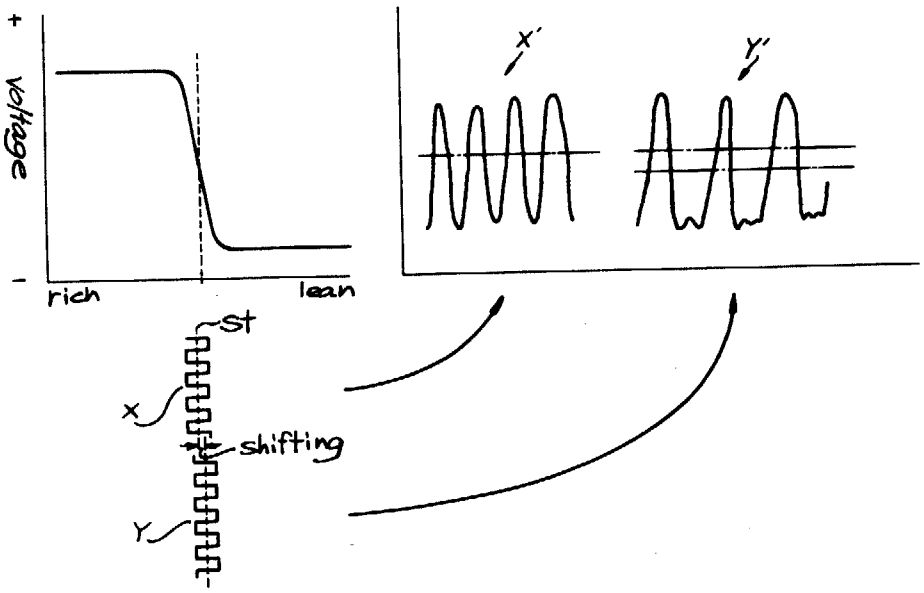
FIG. 7 is a graph showing the operation of the system of the present invention.

For an engine having a characteristic by which exhaust gases contain a large amount of CO and a small of NOx and HC, the system should operate to sufficiently reduce the amount of CO. In order to reduce the CO rather than NOx and HC, it is known that it is effective to control the air-fuel ratio to a slightly leaner side than the stoichiometric air-fuel ratio. On the contrary, in some cases, it is preferable to control the air-fuel ratio to the rich side. In the system of the present invention, it is easy to shift the air-fuel ratio of the mixture to either side. FIG. 7 shows an example of the lean side control. Dither variation X included in the exhaust gases oscillates centering on a value corresponding to the stoichiometric value and the output of the $O_2$ sensor is shown by X'. Reference Y shows a lean-controlled dither variation and Y' shows the output of the $O_2$ sensor.

Figure 8:
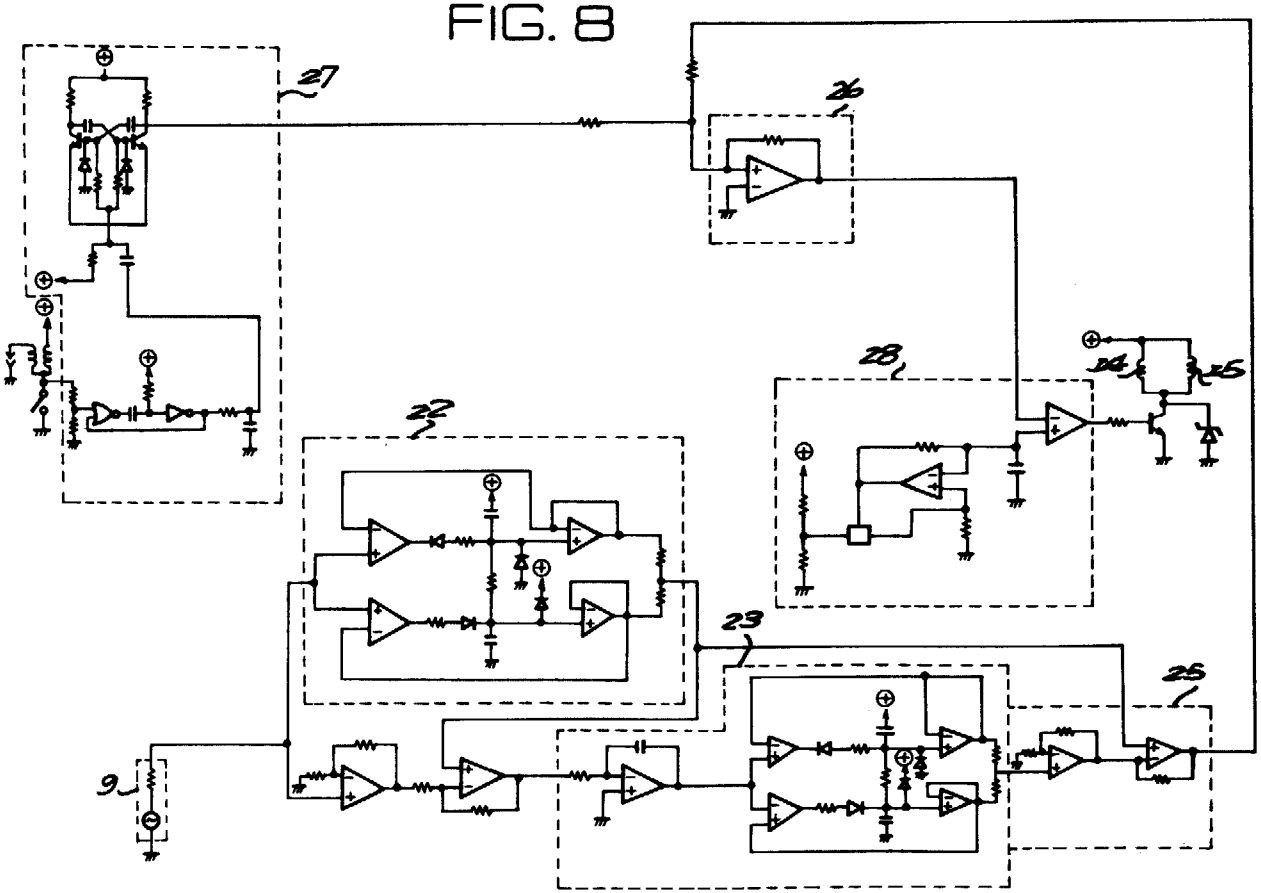
FIG. 8 shows an example of the electronic control circuit.

FIG. 8 shows an example of an electronic control circuit of the present invention. The same parts as in FIG. 3 are identified by the same numerals.

What is claimed is:

1. In an air-fuel ratio control system for an internal combustion engine having an intake passage, an exhaust passage, an air-fuel mixture supply means, an on-off type electromagnetic valve for correcting the air-fuel ratio of the air-fuel mixture supplied by said air-fuel mixture supply means, dither signal generating circuit means for producing a periodical dither signal, a shift control circuit means for shifting the level of the center of said dither signal, driving circuit means, operatively connected to said shift control circuit means, for producing a driving output for said on-off type electromagnetic valve, and an $O_2$ sensor means for detecting the concentration of oxygen in exhaust gases passing through said exhaust passage and producing an output waveform of output voltage, the improvement comprising first circuit means for detecting a middle value between the maximum value and the minimum value of the output voltage of the $O_2$ sensor means in each cycle;

second circuit means for detecting a middle value of the output waveform of said $O_2$ sensor means between upper and lower portions thereof with respect to a predetermined reference value; and shift signal generating circuit means for comparing outputs of said first and second circuit means for generating a difference of said outputs as a shift signal;

said shift control circuit means for controlling the air-fuel ratio of the mixture in such a direction that said difference is decreased.

2. An air-fuel ratio control system for an internal combustion engine according to claim 1 wherein said predetermined reference value is the middle value detected by said first circuit means.

3. The air-fuel ratio control system for an internal combustion engine according to claim 1, wherein said second circuit means is for detecting said middle value of the output waveform of said $O_2$ sensor means such that the area of said output waveform above said middle value equals the area of said output waveform below.

* * * * *